US007121952B2

(12) United States Patent
Coleman, Sr.

(10) Patent No.: US 7,121,952 B2
(45) Date of Patent: Oct. 17, 2006

(54) METHOD AND APPARATUS FOR LASER WELDING OF FLAT STAMPED FASTENERS AND RESULTING CLIP

(76) Inventor: Jerry D. Coleman, Sr., 2118 Stillwater Pl., Wilmington, NC (US) 28405

( * ) Notice: Subject to any disclaimer, the term of this patent is extended or adjusted under 35 U.S.C. 154(b) by 285 days.

(21) Appl. No.: 10/836,533

(22) Filed: Apr. 30, 2004

(65) Prior Publication Data

US 2004/0204254 A1 Oct. 14, 2004

Related U.S. Application Data

(63) Continuation-in-part of application No. 10/238,970, filed on Sep. 10, 2002, now Pat. No. 6,729,962.

(60) Provisional application No. 60/318,459, filed on Sep. 10, 2001.

(51) Int. Cl.

| | |
|---|---|
| ***B21G 3/00*** | (2006.01) |
| ***B21H 9/00*** | (2006.01) |
| *F16B 15/08* | (2006.01) |

(52) U.S. Cl. ..... 470/34; 470/40; 470/44; 470/164

(58) Field of Classification Search ..... 470/2, 470/34, 40, 44, 48, 110, 121, 122, 154, 158, 470/164; 411/442, 443, 444, 445; 219/617, 219/56, 79, 80, 86.24, 91.2

See application file for complete search history.

(56) References Cited

U.S. PATENT DOCUMENTS

| | | | | |
|---|---|---|---|---|
| 3,835,991 | A * | 9/1974 | Brecht | 206/343 |
| 3,861,526 | A * | 1/1975 | Leistner | 206/343 |
| 4,002,098 | A * | 1/1977 | Colechia | 411/443 |
| 4,532,399 | A * | 7/1985 | Jones | 219/117.1 |
| 4,679,975 | A * | 7/1987 | Leistner | 411/443 |
| 5,058,228 | A * | 10/1991 | Wright et al. | 470/128 |
| 6,729,962 | B1 * | 5/2004 | Coleman, Sr. | 470/110 |

* cited by examiner

*Primary Examiner*—Ed Tolan
(74) *Attorney, Agent, or Firm*—Dougherty/Clements

(57) ABSTRACT

A pneumatic or manual impact operated nailer requires fasteners in a clip, typically of about 100 fasteners. The invention provides uniform well-bonded fasteners in a clip for use in a pneumatic or manual nailer, the clips being adhesive-free. In addition, this invention provides a method and apparatus for manufacturing such adhesive-free clips by press-forming the fasteners, placing them in proper orientation in a fixture on a rotatable turret rotating the turret to a welding location, spot welding or seam welding the fasteners, and rotating the turret to a clip unloading station. The clip product is also disclosed.

6 Claims, 5 Drawing Sheets

Fig.3
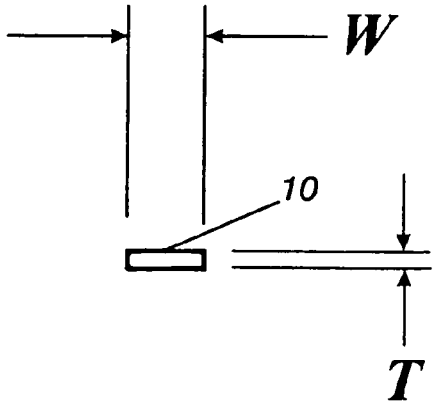
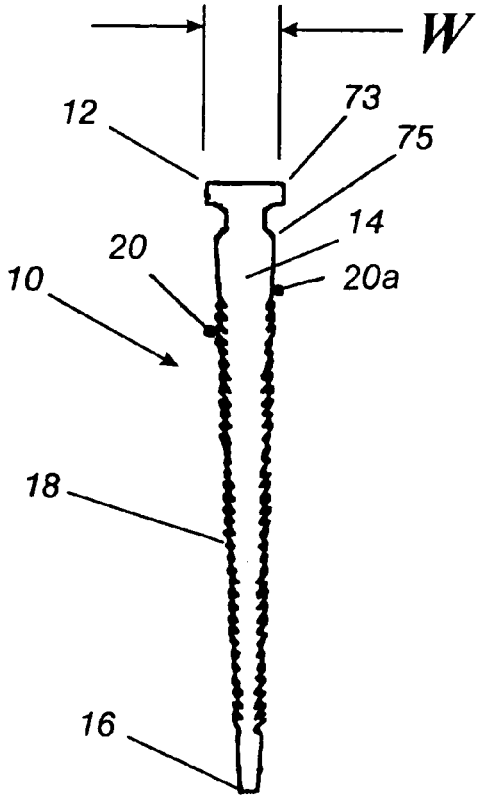
Fig.1
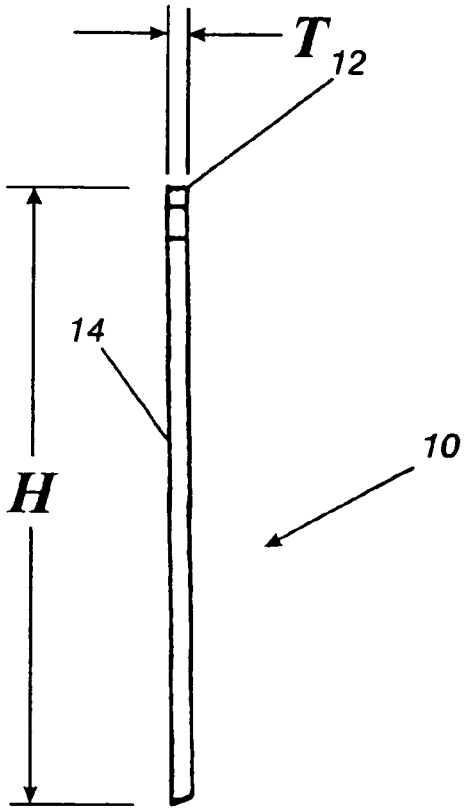
Fig.2

Fig.4
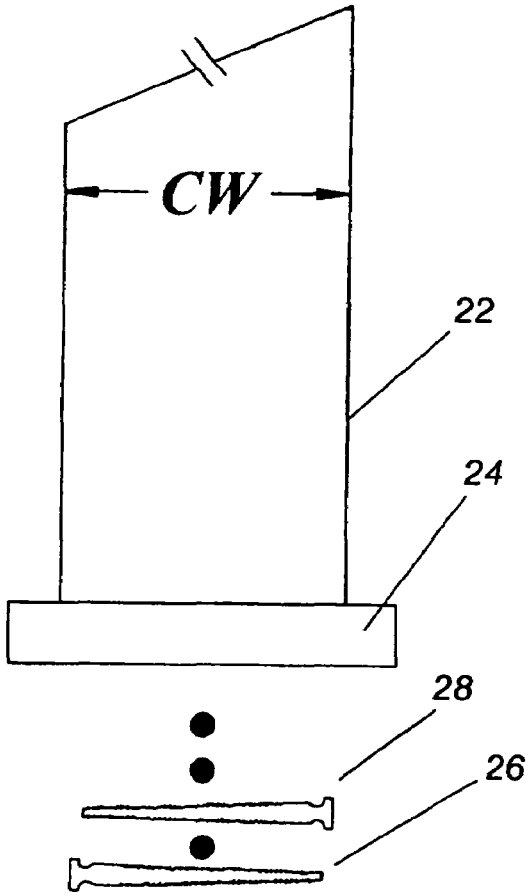
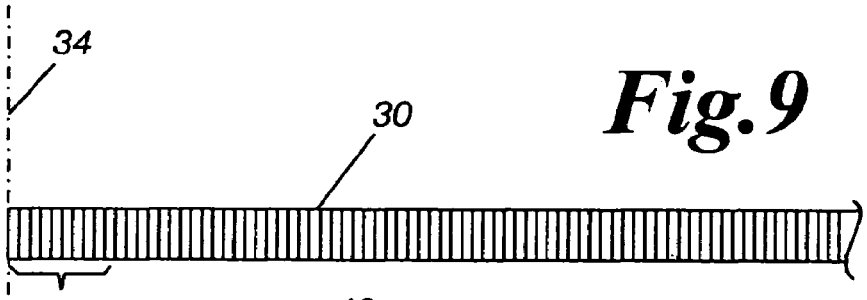
Fig.9
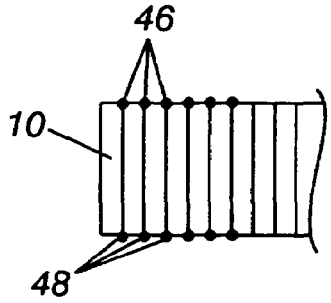
Fig.10

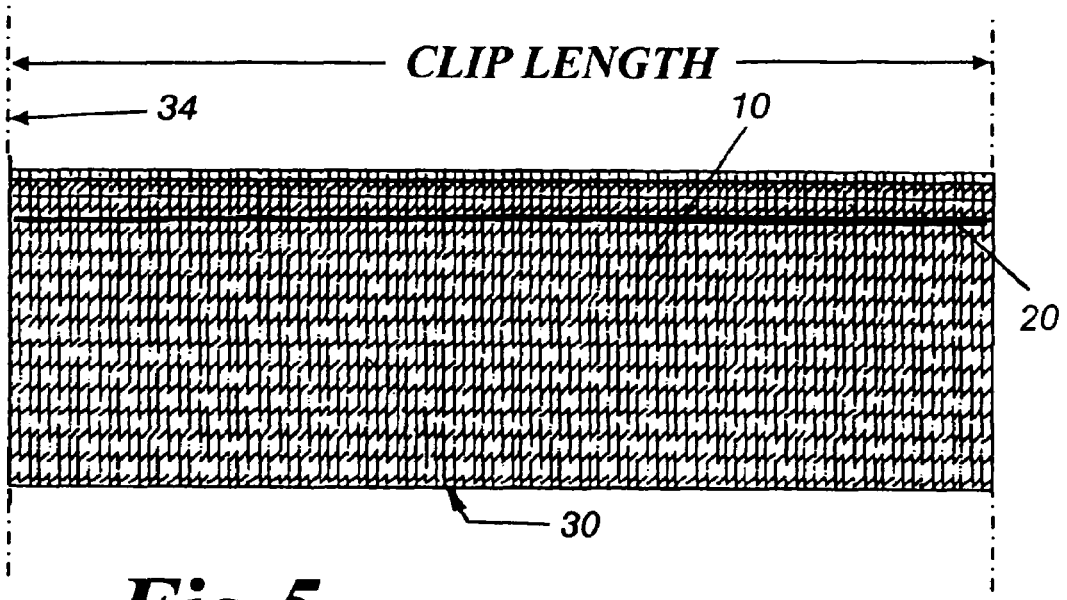
Fig.5
Fig.8
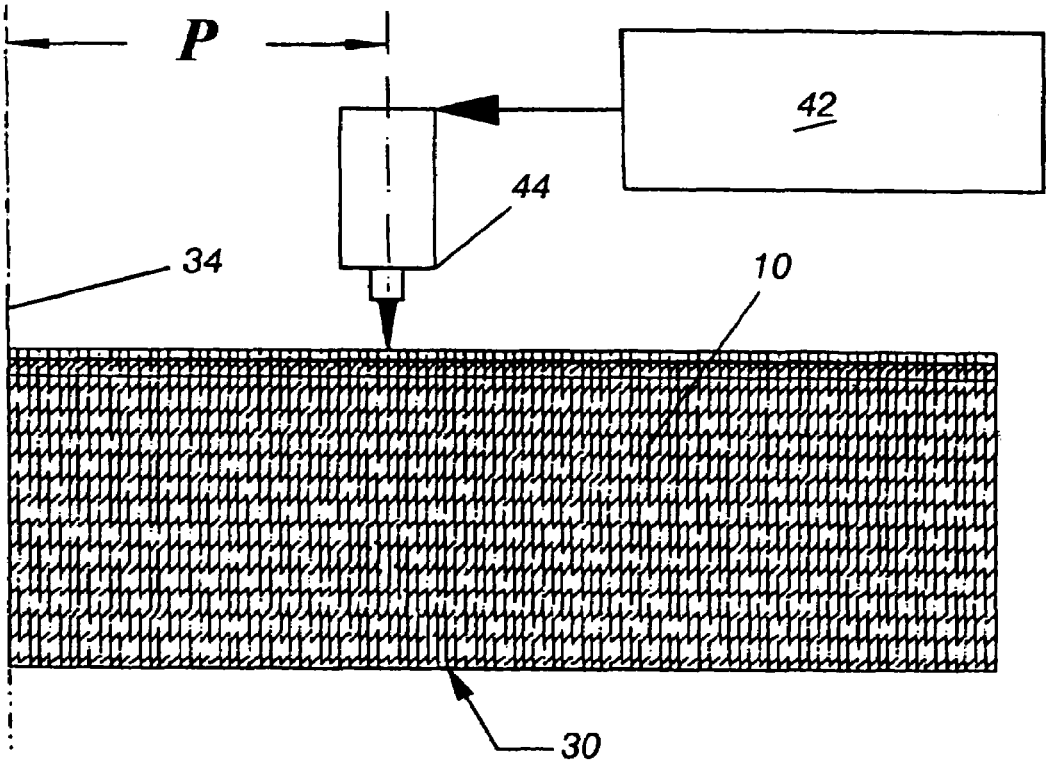

Fig. 6
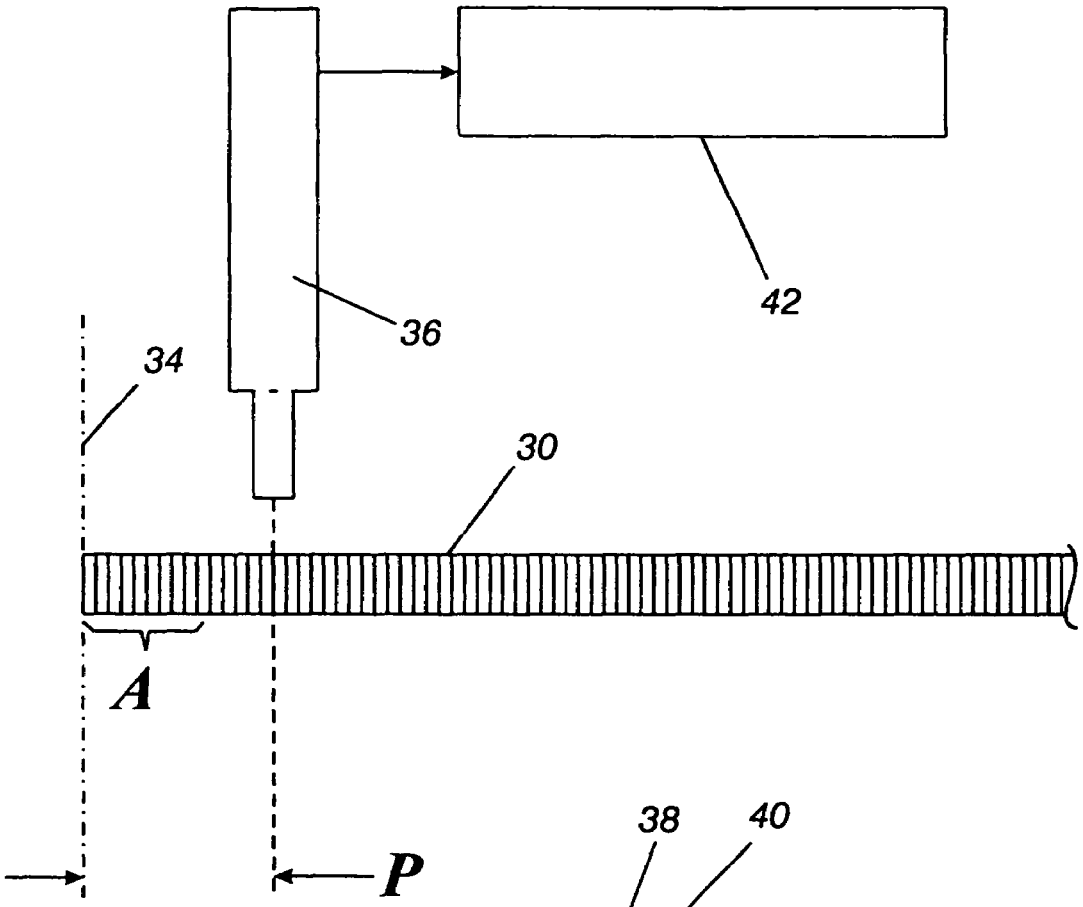
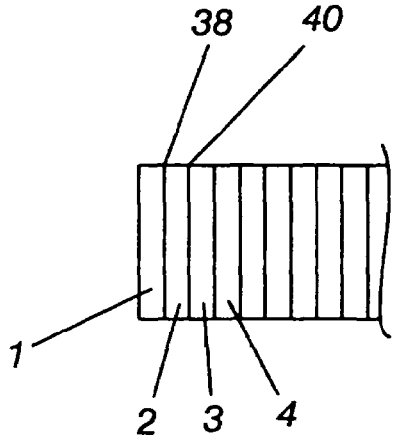
Fig. 7

METHOD AND APPARATUS FOR LASER WELDING OF FLAT STAMPED FASTENERS AND RESULTING CLIP

CROSS REFERENCE TO RELATED APPLICATION

This application is a continuation-in-part of my U.S. patent application Ser. No. 10/238,970, now U.S. Pat. No. 6,729,962, filed Sep. 10, 2002, and claims the benefit of U.S. Provisional Application No. 60/318,459, filed on Sep. 10, 2001.

FIELD OF THE INVENTION

The present invention relates to a method and apparatus for forming a clip of die-formed fasteners, hereinafter referred to as nails, ready for insertion into an impact-fired pneumatic or manual nailer or equivalent, and the resulting fastener clip product.

BACKGROUND OF THE INVENTION

A known method of forming clips or assemblies of nails for pneumatic or manual nailers is as follows. Nails are stamped out of approximately 2.2-inch wide by 0.061-inch thick C1008 steel which is provided in 800 to 900-pound coils. This size coil provides sufficient material for about 200,000 nails. Other coil dimensions and other materials may be used. The nails are formed in a 30-ton press or equivalent using 10 progression dies or equivalent. The nails are formed head to toe. For instance, the head of the first nail is on the right-hand edge of the strip, while the head of the second nail is on the left-hand edge. Although the strip is nominally 0.061-inches thick, it can still be within thickness specification if it is slightly wedge-shaped, with the thickness of the right-hand edge differing from that of the left-hand edge by as much as 0.0005-inches. The nail is approximately symmetric in two ways about its longitudinal axis. This axis is a line of symmetry or the center line of the material. Facing this center line from the side of the nail, the nail appears substantially rectangular with 0.0305-inches of material, nominally on either side of the center line. Facing the center line from the broad face of the nail, the nail has a press-formed head above a tapering body. The body of the nail is trapezoidal with the side of the trapezoid remote from the head almost forming a point. There is a region of serration over a portion of the nail to enhance the fastening function. The serration is directionally shaped to impede the extraction of a nail after being driven. The nails are approximately 2-inches long with approximately a 0.25-inch head.

After forming, the first nail moves down through a bolster and enters a carrier on the right, the second nail moves through a corresponding bolster and enters a carrier on the left. The motion is not smooth. The nails move in 0.061-inch increments, driven by the pressure of the press at more than 500 increments per minute. The objective of the operation is to form and ship a clip having approximately 100 nails ready for insertion into an impact-fired pneumatic or manual nailer. To form the clip, adhesive is applied by wiping along both sides of the nails as they are moved in the 0.061-inch increments. Ideally, the clip is continuous. However, the currently used method is far from ideal. The vibration, tolerances and the variable properties of the adhesive combine to cause quality control problems. Due to vibration, sometimes a clip will break, leaving a smaller clips containing fewer nails. The viscosity of the adhesive varies with atmospheric conditions causing the amount of adhesive material applied to vary unacceptably. If excessive adhesive is applied, clips sometimes stick together in the shipping carton. Worse, a clip with excessive adhesive can jam the user's nailer. If insufficient adhesive is used, clips will break into pieces resulting in scrap. In the presently used method, the manufacturing operators are required to visually inspect work-in-process. If the adhesive is too heavy, the operator reports the condition to the upstream facility and an adjustment is made. The clip is not guaranteed to be robustly formed. To meet specification, the bow (curve) in the clip must be less than about 0.015-inches. The packing operators are required to gage the clips for bow and to square them before packing. This is labor intensive and, therefore, expensive. If the operator judges that a clip is not sufficiently square, the operator places that clip in an air-driven press to square it. Due to tolerances, right and left-hand nails are sufficiently different in the process that they must be kept segregated through the formation of clips. In addition, the curing adhesive results in toxic fumes requiring ventilation. The adhesive used is flammable and presents a fire hazard. Due to these problems, the known method currently in use is unsatisfactory in both yield and expense. Moreover, the method creates environmental hazards and safety problems for the production workers.

SUMMARY OF THE INVENTION

The present invention is a method and an apparatus for forming a clip of nails for use in an impact-fired pneumatic or manual nailer. As in the known method, nails are stamped out of steel strip, preferably out of approximately 2.2-inch wide by 0.061-inch thick C1008 steel provided in 800 to 900-pound coils, which is sufficient material for about 200,000 nails. Other dimensions and other materials may be used. The nails are formed in a 30-ton press or equivalent using ten progression dies or equivalent. The finished nails are formed head to toe. The head of the first nail is on the right-hand edge of the strip. The head of the second is on the left-hand edge. The strip is nominally 0.061-inches thick, but can still be within specification tolerance if it is slightly wedge-shaped, with the right-hand edge differing from the left-hand edge by no more than 0.0005-inches.

Four precision fixtures are mounted on a rotatable turret. Each fixture has a coordinate reference system. Nails exit the press on the right-hand and left-hand bolsters. Loose nails in groups of 100 are alternately fed into one of the fixtures. Each fixture is adapted to precisely square the loose nails so that the heads of the nails are substantially planar and that the longitudinal center lines of the nails are substantially in a single plane. The fixture holds 100±2 nails, since the exact number of nails which the fixture will hold is a function of the material thickness and process tolerances. Any number in this range is satisfactory for use in a pneumatic or manual nailer. When the first fixture is full, that is the nails placed therein will form an appropriate length clip satisfying a minimum number of nails, the turret rotates 90°. Such rotation places a new fixture in proper position to receive and align the next approximately 100 nails in the aforementioned two planes. Upon this 90° rotation, the first, full, fixture is now positioned at the welding system. The nails in the fixture are maintained in position. An optical servomechanism locates the position where the first nail and the second nail in the fixture abut with respect to the reference location. This positional information is captured in computer storage, and the servomechanism proceeds to locate the position where the second and third nails abut. The servomechanism continues to operate in this fashion until all the nail abutment points are recorded. After it is mechanically possible, a computer-operated laser-based welding head follows the optical servomechanism. The laser-based welding system, which is keyed to the same reference point, retrieves the stored coordinate data from the computer storage. The welding head is moved translationally from the reference point to the coordinate of the first and second nail abutment, whereupon the first and second nails are spot welded to form a partial clip. The two spot welds assure that the first two nails maintain the planarity of the top surface of the nails and the planarity nails' center lines that was previously established when the nails were positioned in the precision fixture. The welding system retrieves the next coordinate and the welding head is translated to the next coordinate where the third nail is spot welded to the partial clip. The process continues until the clip is complete. In a 100-nail clip, 198 spot welds are performed, resulting in the fixing of the nails into a 100-nail clip. The actual number of welds can vary due to the aforementioned allowable±2 variation in nail count per clip. This operation requires significantly less time than the nail formation and loading and precision alignment at the press position. The turret rotates 90°, resulting in the first clip being positioned at the unloading station. The second set of approximately 100 nails is positioned for welding. A third set of nails is precisely aligned in a third fixture. The operation is continuous. No adhesives are used. Each clip is precisely formed and there is no requirement for special handling of out-of-square clips in packing.

Alternatively, the clips can be assembled by seam welding rather than spot welding. Seam welding is faster than spot welding, which allows an increase in production throughput.

OBJECTS OF THE INVENTION

It is the primary object of the present invention to provide a clip of approximately 100 nails for a pneumatic or manual nailer that is adhesive-free, therefore presenting no possibility for jamming the feed in the nailer due to adhesive fragments or excessive bowing.

Another object of the present invention is to provide a clip of approximately 100 nails for a pneumatic or manual nailer with sufficiently uniform bond strength between adjacent nails that the clips remain bonded and mechanically stable throughout subsequent handling, shipping and insertion into a nailer.

Another object of the present invention is to provide a clip of approximately 100 nails for a pneumatic or manual nailer with sufficiently uniform bond strength between adjacent nails that to hold the clip securely in a nailer so substantially no problems arise when driving the nails with the nailer.

Another object of the invention is to provide a method for manufacturing clips of nails for a pneumatic or manual nailer with substantially no environmental effluents, and no highly flammable materials, resulting in substantially improved worker safety, and without requiring the use of protective breathing apparatus.

An additional object of the invention is to provide a method for manufacturing clips of nails for a pneumatic or manual nailer with a substantially improved manufacturing yield by reducing scrap to virtually zero when compared with the known methods.

An additional object of the invention is to provide a method for manufacturing clips of nails for a pneumatic or manual nailer with substantially improved manufacturing throughput.

BRIEF DESCRIPTION OF THE DRAWINGS

The foregoing and other objects will become more readily apparent by referring to the following detailed description and the appended drawings in which:

FIG. 1 is a front view of a single nail produced by the invented process.

FIG. 2 is a side view of the nail of FIG. 1.

FIG. 3 is a top view of the nail of FIG. 1.

FIG. 4 is a schematic diagram of a nail forming process utilizing a press.

FIG. 5 is a side view of nails assembled in a precision fixture and showing a reference line or plane.

FIG. 6 is a diagrammatic view of an optical servomechanism for locating abutment points between the assembled nails and an associated computer control system according to the invention.

FIG. 7 is an enlarged view of the nail indicated by A in FIG. 6.

FIG. 8 is a diagram illustrating the positioning of the welding mechanism relative to the reference line.

FIG. 9 is a top view of the assembled fasteners relative to the reference line.

FIG. 10 is an enlarged view of a portion of FIG. 9 showing fasteners B and illustrating the position of the spot welds.

DETAILED DESCRIPTION OF THE PREFERRED EMBODIMENT

Figure 11:
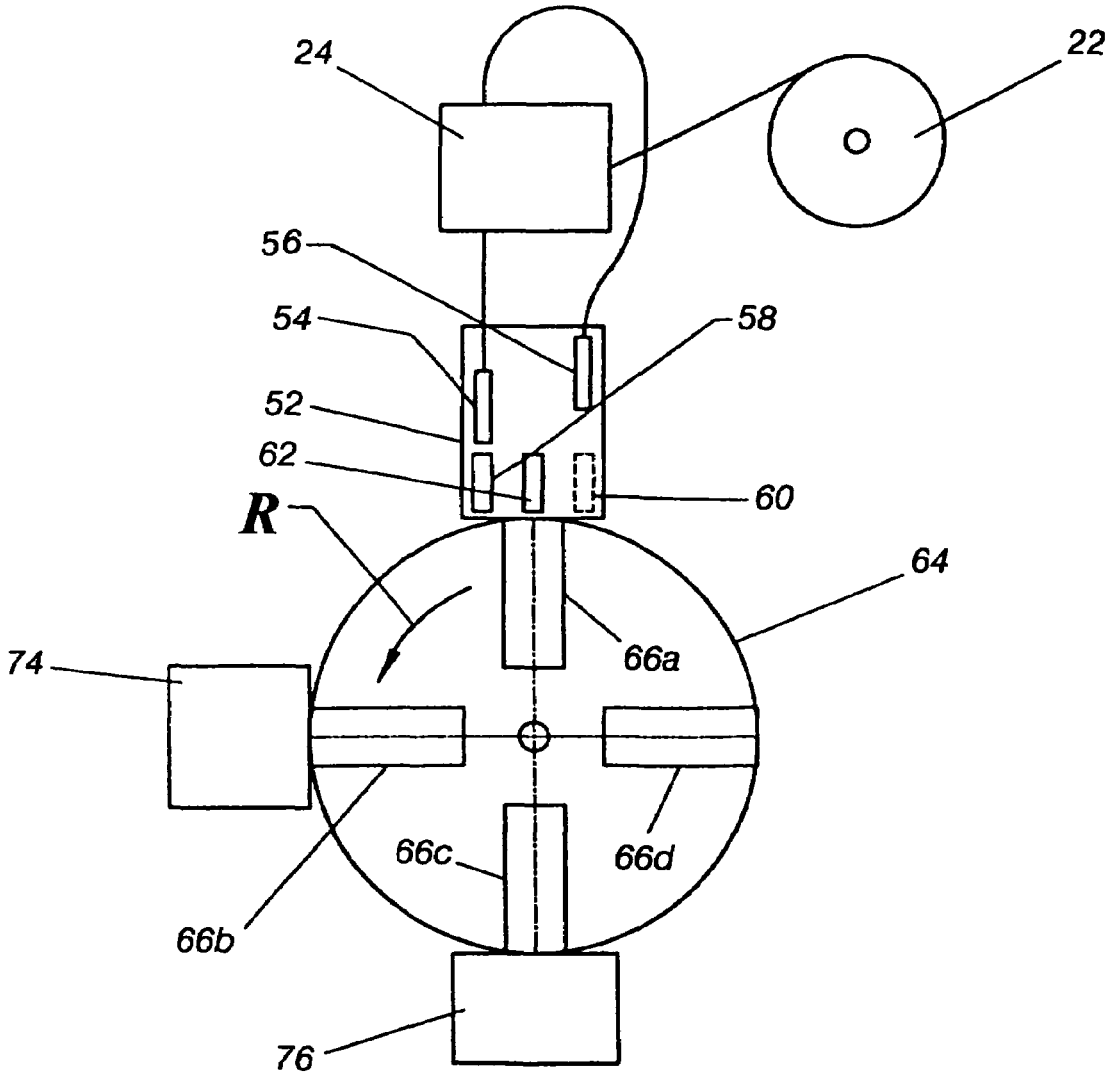
FIG. 11 is a schematic arrangement of a fastener clip manufacturing apparatus according to this invention.

The present invention is a method and apparatus for forming a clip of nails for use in an impact-fired pneumatic or manual nailer. Referring now to FIGS. 1, 2, and 3, the individual nail 10 produced by the process has a head 12 that presents a face having a width W of approximately 0.25 inches and a thickness T of about 0.061-inches. The nail is symmetric about its center line in the other two views. It is substantially rectangular as shown in the side view of FIG. 2. FIG. 1 shows details of the cross section. Note the head 12 and the serrated side edges 18. The height H of the nail is determined by the width CW of the coil material (see FIG. 4) and the objective for the width of the head 12 of the nail 10. Other head shapes such as rounded heads can be used. It will be appreciated by those skilled in the art that the source material, die wear, and many other factors will cause the actual dimensions of the nail to vary. In addition, the dimensions listed herein are provided only to clearly illustrate the invention and should not be construed as limiting the invention in any way. As an example of typical tolerances, the strip is nominally 0.061-inches thick, but can still be within specification tolerances if it is slightly wedge-shaped, with the right-hand edge differing from the left-hand edge by no more than 0.0005-inches.

When seam welding is used, seam welds 20 and 20*a* will be formed on each side of nail 10, preferably at different elevations, as shown in FIG. 1.

In both the invented method and in the prior art, nails 10 are stamped out of approximately 2.2-inch wide by 0.061-inch thick C1008 steel which is provided in 800 to 900-pound coils 22. The process introduces feedstock from coil 22 into a 30-ton press 24 or equivalent using about ten progression dies or equivalent. The nails exit the press operation with heads on the left side as indicated by reference numeral 26 and the right side as indicated by reference numeral 28.

FIG. 5 illustrates an assembly 30 of nails 10 as assembled in a precision fixture. The fixture contains a reference point, line or plane 34. Note that the position of the reference point is not critical to the invention. The reference point is just the origin of the coordinate system. The abutment point for every pair of nails in the assembly is located with respect to the reference point. A joining mechanism, i.e., a spot welder 44 or seam welder is positioned to weld the abutment points by positioning the welder with respect to the reference point 34. The reference point could be adjacent to any nail or no nail at all, provided that the nails in the fixture remain in the same position with respect to the reference point during joining. Although welder 44 is shown above the top of the nails, it will be understood that the welds are actually formed at the side of the nails.

The first nail from its respective bolster is placed in a fixed position in the fixture with respect to the reference point 34. Each subsequent nail is placed into the fixture in such manner that the tops of the nails are substantially in a single plane and the longitudinal center lines are substantially in a single plane. If the nails do not have flat heads, then the center of each nail head is aligned in a line. The nails are placed with a maximum skew in abutments of 2°. Misalignment is held within 0.015-inches. The nails do not shift position with respect to the reference point until the joined clip is freed prior to discharge or removal from the fixture.

FIG. 6 is a diagrammatic view of the optical servomechanism for determining the abutment locations. An optical sensing head 36 scans the loose nails 10 that are held in precise location in the fixture. The position of each abutment point relative to the reference point 34 is determined. For example point 38 is the abutment point between nails 1 and 2 and point 40 is the abutment point between nails 2 and 3. The positional data is retained in a computer system 42 at least until it is used in the welding step, and then data locations may be made available for subsequent use. The optical servomechanism is preferably based on an electronic camera.

Note that when the joining procedure is continuous seam welding, the optical servomechanism is not required.

FIG. 8 illustrates the positioning of the welding mechanism 44 at a distance P from the reference point 34, which was determined by the servomechanism. The positional data is retrieved from the computer 42 in which it was stored, and directs the welder positioning mechanism to the appropriate position to effect the required welds. For example points 38 and 40 are the abutment point between nails 1 and 2 and the abutment point between nails 2 and 3, respectively. To effect the welds needed for nails 1 and 2, the welding mechanism is positioned to coordinate 38. After these welds are complete, the location coordinates in computer storage may be freed, if desired. The weld head is then positioned to the coordinate for the abutment point 38 between nails 2 and 3, and the required welds effected. The welds are preferably effected by a laser-based welding means, but other mechanisms can be envisioned without departing from the intent of this invention.

FIGS. 9 and 10 are top views of the clip 30 illustrating the general position of the welds. Spot welds or seam welds 46 and 48 are carried out on each side of the nail. One weld is preferably on nail shoulder 75 (see FIG. 1) and the other weld is on the opposite side of the nail, usually farther from the head. This preserves the planarity of the head surface and the nail center lines that are established during their precise placement in the fixture. The spot or seam welds can be at any desired distance from the end point 73 on the head, but preferably are not on the head 12 itself.

As shown in FIG. 11, the clip-making method may be implemented on the apparatus 50, shown schematically. The feedstock 22 consists of approximately 2.2-inch wide by 0.061-inch thick C1008 steel which is provided in 800 to 900-pound coils. Each coil holds about 1000-feet of material enough for 106,000 nails equivalent to 1,060 clips. The 30-ton press 24, using 10 progression dies runs at 500 increments per minute. The nails are formed as right and left-hand individual nails that may be different because of die and material tolerances. Since the press produces two nails per increment, nails exit the press at 500 nails per minute on each side of the press. The nails are fed into a shuttle mechanism 52 having two receiver stations 54, 56. The receiver stations are staggered, usually approximately 3 inches, so that when receiver station 54 is full the shuttle moves the first unbonded nail assembly 30 into the shuttle station 58. The shuttle then picks up receiver station 56 which has been filled with nails from the opposite side of the press. The shuttle mechanism has two shuttles 58 and 62, but 3 shuttle stations 58, 60, 62, the central station 62 being adapted to feed fasteners into a fixture 66. A turret 64, or rotatable disc, has four fixture locations, 66*a*, 66*b*, 66*c*, and 66*d*. When the fixture in location 66*a* is filled, turret 64 rotates 90° in direction of rotation R in substantially less time than it takes for the next nail to arrive at the press egress point 62. This time period is on the order of 120 milliseconds. Although the average rotation rate of the turret is just 1.25 rpm, it turns at the rate of about 250 rpm when rotating merely a quarter turn. The rotation of the turret is triggered by a sensor associated with fixture 66*a* at the loading station showing a full clip length.

When a coil of feedstock 22 is expended, there may be a short changeover interruption as the press feed switches to a second coil. By keying the operation to a full clip length in the fixture at press exit 62, the turret simply waits for the changeover, and continuous operation resumes as nails from the second coil progress through the press.

A set of approximately 100 nails that are precisely aligned such that the nail heads are substantially in one plane and the nail center lines are substantially in one plane in a fixture are positioned at the welding station 74. The optical servomechanism 36 in the welding station locates the place where the first nail in the assembly 30 abuts the second nail and registers that position in computer storage. The servomechanism locates each successive abutment point and records each successive position in computer storage until every abutment point is recorded.

When the space above the first abutment point is free of the optical servomechanism, the welding unit retrieves positional information from the computer storage and is precisely positioned at the first abutment point. This is achieved because the welder and the optical servomechanism operate from the same reference point or line in the fixture. Two spot welds are effected at this abutment and the welder moves incrementally to the next position after retrieving that positional data from computer storage. The welding process continues until the entire clip is formed. The welds preferably are performed by a laser welder. The positioning and welding operations take less than 100-milliseconds per nail, and, nominally, 198 spot welds or one continuous seam weld on each side are needed to complete the clip welding operation. The welding is completed in fixture 66*b* in ample time before the next turret rotation. When the fixture at the press-exit position 66*a* has sufficient nails in precise alignment to form a next fastener assembly, the turret rotates a quarter turn. This puts the newly completed clip in position 66*c* for unloading or discharge. The discharge extraction can take any time less than about 10-seconds, but typically requires substantially less time. From the unload station 76, the clips are conveyed, typically by a gravity conveyor to the packing area.

When seam welding, one continuous weld is made on each side of the clip, preferably at different elevations from the top of the nails. Seam weld 20 is shown in FIG. 5 on one side of the clip 30. The weld on the opposite side is at a different distance from the nail head. Seam welds are usually about ½ inch to ¾ inch from the top of the nail head.

The finished clips contain no adhesive and no organic materials of any kind. No special inspections or post-fabrication alignment inspections are required. No pneumatic squaring of out-of-specification clips is required. No environmental hazards, respiratory hazards or fire hazards are present in the process. The nails will not jam the nailer but they will separate readily in use.

Alternatively the nails or fasteners may be made from any desired stampable materials, including, without limitation, steel, stainless steel, metal alloys, aluminum, aluminum alloys, copper alloys, brass, and certain hard non-brittle plastic materials. It is, however required that the material be stampable without breaking and without jamming the stamping equipment. The nails and clips may be any desired thickness or length, and may be made from any desired width or thickness of material.

SUMMARY OF THE ACHIEVEMENT OF THE OBJECTS OF THE INVENTION

From the foregoing, it is readily apparent that I have invented a clip of approximately 100 nails for an impact-operated pneumatic or manual nailer that is adhesive-free and mechanically precise to an unprecedented degree, therefore presenting no possibility for jamming the feed in the nailer due to adhesive fragments or excessive bowing, and moreover, a clip with sufficiently uniform bond strength between adjacent nails that the clips remain bonded and mechanically stable throughout subsequent handling, shipping and insertion into the nailer, and additionally, a clip with sufficiently uniform bond strength between adjacent nails that substantially no problems arise when driving the nails with said nailer. The invention also encompasses a method for manufacturing clips of nails for a pneumatic or manual nailer with substantially no environmental effluents, no highly flammable materials, and substantially improved worker safety, without requiring the use of protective breathing apparatus, and also, a method for manufacturing clips of nails for a pneumatic or manual nailer with substantially improved manufacturing yield by reducing scrap to virtually zero when contrasted with the unimproved method, and also, a method for manufacturing clips of nails for a pneumatic or manual nailer with substantially improved manufacturing throughput.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A method of manufacturing an adhesive-free clip of fasteners for use in an impact operated tool comprising:

a) forming a plurality of loose fasteners from a metal sheet, each fastener having a generally planar head and a longitudinal center line;

b) collecting said loose fasteners;

c) filling a mechanical fixture by positioning and aligning said loose fasteners so that the heads of each of said fasteners are substantially coplanar and the center lines of said fasteners are substantially coplanar;

d) delivering the filled fixture to a welding station;

e) locating a reference line with regard to said fixture and locating position coordinates where each pair of adjacent fasteners abut with respect to said reference line, and recording such abutment coordinates;

f) positioning a spot welder according to said coordinates;

g) spot welding the first two fasteners in such manner that the planarity of the fastener heads and the fastener center lines are maintained, and forming a partial clip;

h) relocating the spot welder to the next abutment coordinates and spot welding each fastener to its adjacent fastener while maintaining the planarity of the fastener heads and fastener center lines until the entire clip is completed;

whereby the resultant clip is adhesive-free, and the clip is so precisely formed that no post-assembly operations are required.

2. A method according to claim 1, wherein said welder is a spot welder.

3. A method according to claim 1, wherein said welder is a seam welder.

4. The method of claim 1 wherein locating the position coordinates where each pair of adjacent fasteners abut with respect to said reference line is accomplished by an optical servomechanism which records the location coordinates in a computer from which the abutment coordinates are retrievable.

5. The method of claim 1 wherein said welding is accomplished by laser welding to effect each weld.

6. The method of claim 4 wherein the optical servomechanism is an electronic camera.

* * * * *